United States Patent [19]

Gravely, Sr.

[11] 4,151,718

[45] May 1, 1979

[54] ELECTRONIC CONTROL FOR HYDRAULIC PRESS

[75] Inventor: Edward M. Gravely, Sr., Martinsville, Va.

[73] Assignee: Henry County Plywood Corporation (2/3), Ridgeway, Va.

[21] Appl. No.: 748,178

[22] Filed: Dec. 7, 1976

[51] Int. Cl.[2] ..... F15B 21/02; F15B 21/08

[52] U.S. Cl. ..... 60/328; 60/459; 60/DIG. 2; 144/281 R; 60/368

[58] Field of Search ..... 144/281 R; 100/260 R; 91/35, 37, 42; 60/321, 368, 379, 394, 395, 403, 433, 459, 486, DIG. 2, 328

[56] References Cited

U.S. PATENT DOCUMENTS

| | | | |
|---|---|---|---|
| 2,784,754 | 3/1957 | Berthelesen | 144/281 R |
| 2,923,973 | 2/1960 | Ninneman | 60/379 X |
| 3,628,330 | 12/1971 | Miller | 60/DIG. 2 |
| 3,911,677 | 10/1975 | Collins | 60/368 |

*Primary Examiner*—Edgar W. Geoghegan
*Attorney, Agent, or Firm*—Clarence A. O'Brien; Harvey B. Jacobson

[57] ABSTRACT

An electronic control device for hydraulic presses for making plywood and the like having electronic computer structure for developing a control for the desired hydraulic pressure having multiple input units on which at least the width, length and unit pressure may be set into the device for automatically effecting the calculation of the required hydraulic line pressure in order to apply the proper pressure upon the laminated plywood panels. The control device also anticipates maximum line pressure and cuts off the hydraulic pump(s) before the desired pressure is reached so that the inertia of the pump(s) and motor(s) will not increase the resultant line pressure above the predetermined desired pressure.

8 Claims, 14 Drawing Figures

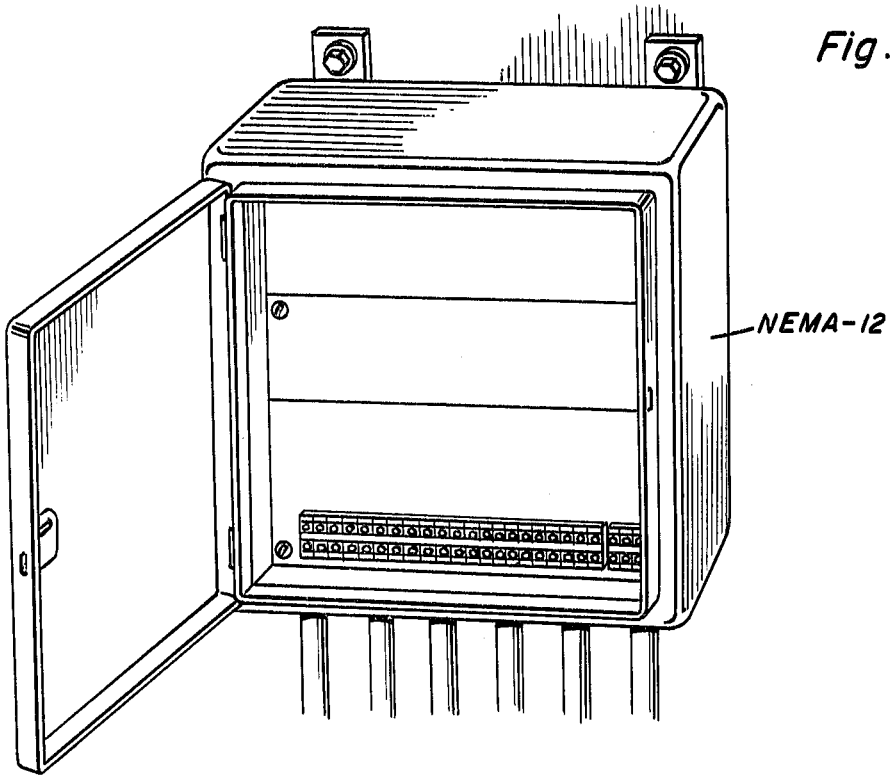
Fig. 4
Fig. 5
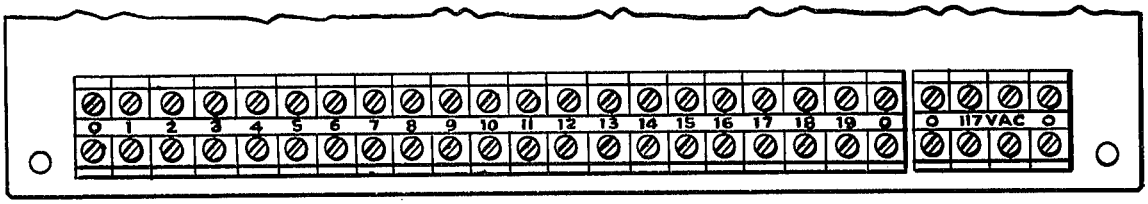
Fig. 6
| WIDTH OF PLYWOOD IN INCHES | LENGTH OF PLYWOOD IN INCHES 24 | 30 | 36 | 42 | 48 | 54 | 60 | 66 | 72 |
|---|---|---|---|---|---|---|---|---|---|
| 18 | 250 | 320 | 380 | 445 | 505 | 570 | 650 | 695 | 775 |
| 24 | 340 | 420 | 505 | 590 | 690 | 775 | 860 | 940 | 1025 |
| 30 | 420 | 530 | 650 | 740 | 850 | 965 | 1075 | 1160 | 1280 |
| 36 | 505 | 650 | 775 | 900 | 1025 | 1150 | 1280 | 1405 | 1530 |
| 42 | 590 | | | | | | | | |
HYDRAULIC PRESSURES IN PSI Fig. 10
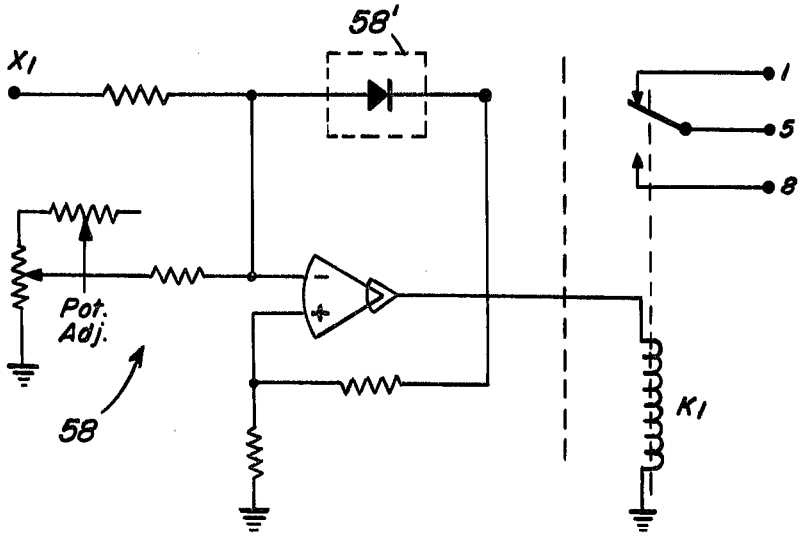
Fig. 11
| TERM No. | DESCRIPTION |
|---|---|
| 1 | Input from "Length" Pot. 0/10V |
| 2 | Output to "Width" Pot. 0/10 V |
| 3 | Input from "Width" Pot. 0/10V |
| 4 | Input from "Pressure" Pot. 0/10V |
| 5 | Input 0/2000 PSIG 0/5V DC |
| 6 | Common |
| 7 | AC Lamp Connection |
| 8 | N.C. } Press Lockout |
| 9 | Pole } Press Lockout |
| 10 | N.O } Press Lockout |
| 11 | N.C. } Hydraulic Pump |
| 12 | Pole } Hydraulic Pump |
| 13 | N.O. } Hydraulic Pump |
| 14 | Calculated Output 0/10V DC, 0/2000 PSIG |
| 15 | (+) 10V Reference |
| 16 | (−) 10V Reference |
| 17 | (+) 18V DC Power |
| 18 | Common |
| 19 | (−) 18V |
Fig. 12
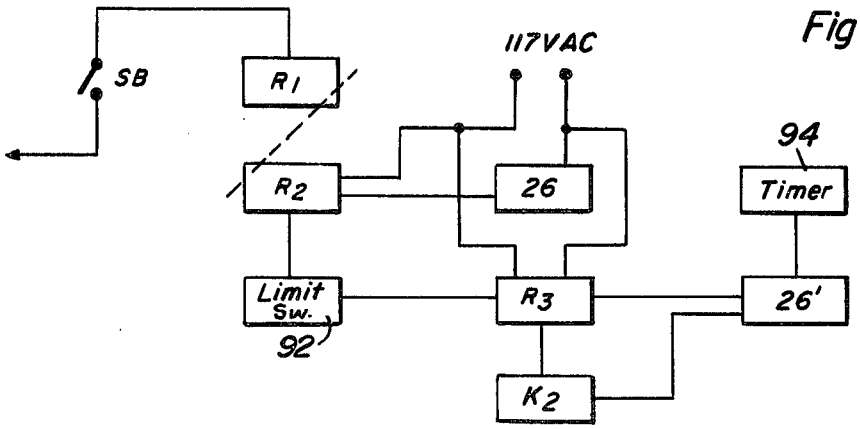

ELECTRONIC CONTROL FOR HYDRAULIC PRESS

BACKGROUND OF THE INVENTION

1. Field of the Invention

This invention relates generally to devices for controlling the hydraulic operating pressure of hydraulic presses as used for laminating plywood.

2. Description of the Prior Art

A common problem with known type hydraulic laminating presses for plywood and the like is that the operator must consult a table in order to determine the amount of hydraulic line pressure for the press in pounds per square inch depending on the panel size (area) and desired unit pressure to be applied to said panel (pounds per square inch). The misuse of this table will result in over-pressure with the resultant plywood panel being too thin with glue being squeezed out or the other extreme of under-pressure being applied with a result in poor bonding.

Another problem with known type controls for plywood hydraulic presses and the like is that when different sizes of plywood panels are being pressed, or different numbers of panels are being pressed, with the numbers varying from time to time, it is often quite easy to make a mistake on the part of the operator with the result of failure to properly control the hydraulic pressure of the press in order to effect the desired resultant panels.

Another problem with controllers for different types of systems employing hydraulic or pneumatic fluid control is that the devices do not accurately combine the several inputs of desired analog quantities in order to produce an overall resultant control which is accurate.

Known prior art U.S. Pat. Nos. which may be pertinent to this invention are as follows: 2,717,421 C. T. Beeson Sept. 13, 1955, 2,726,775, C. W. Howard Dec. 13, 1955, 2,784,754 V. Berthelsen Mar. 12, 1957, 2,810,930 M. D. MacDonald et al Oct. 29, 1957, 3,309,510 I. Brown Mar. 14, 1967, 3,311,837 H. Moreines Mar. 28, 1967, 3,313,984 A. C. Hupp Apr. 11, 1967, 3,331,411 G. Cecchi July 18, 1967, 3,454,787 S. C. Gelernter July 8, 1969, 3,855,101 H. M. Wilson Dec. 17, 1974, 3,873,855 J. N. Reddy Mar. 25, 1975, 3,875,427 R. B. Riley Apr. 1, 1975, 3,879,668 A. P. Edwards Apr. 22, 1975, 3,932,766 D. Kudeljan et al Jan. 13, 1976.

None of these known prior art devices offers the new and unique features of the invention disclosed herein.

SUMMARY OF THE INVENTION

An object of the present invention is to provide an electronic control for hydraulic presses and the like which will accurately control the maximum hydraulic pressure of the press system.

Another object of the present invention is to provide an electronic control for a hydraulic plywood press which has a given ram area over which the hydraulic pressure acts, and in providing inputs for the length and width of a plywood panel to be put under pressure together with an input for the pounds per square inch of pressure to be so applied. By using an electronic controller as disclosed herein for calculating the overall pounds per square inch to be developed in the hydraulic press, an accurate and programmable manner of developing the pressure is achieved.

A further object of this invention is to provide an electronic control for a hydraulic press which anticipates the amount of hydraulic pressure being generated in order to prevent overrun of the hydraulic pump and motor and exceeding of the desired predetermined unit pressure.

A still further object of this invention is to provide an electronic control device for accurately calculating the necessary unit pressure to be used by a hydraulic press structure and to eliminate the inaccurate and error probability of conventional type pressure charts as generally used with such hydraulic presses.

Another additional object of this invention is to provide an electronic controller device which has a plurality of adjustable dials which when set feed voltage inputs to buffer amplifiers, then to a multiplier to produce a computed voltage, which is then compared with a signal from a line pressure transducer and a preset voltage corresponding to maximum pressure for any given press. An alarm feature is also included to prevent setting combinations which require more line pressure than the press can provide. Overrun compensation circuits are also provided as well as accurate power supply and reference voltage supply circuits. Such an electronic system may be used with various types of devices which need to be accurately controlled and regulated with adjustable analog inputs as applied by an operator thereof.

A further object is to provide a controller which may be used with either analog inputs, or digital inputs, to expand the overall system capabilities.

The electronic controller device of this invention in combination with conventional-type hydraulic presses as used for producing plywood panels and the like has a number of very important features. All hydraulic plywood presses have a given ram area over which the hydraulic or fluid pressure acts, creating a total force available of P times A pounds, where P equals line pressure in pounds per square inch and A equals ram area in square inches. This total force is distributed over the surface of the plywood charge put into the press so that the unit pressure on the plywood is equal to pounds/area of plywood. Since it is desirable to maintain a given unit pressure on the plywood, a customary practice has been to utilize a chart or charts for each press to which the operator would refer in order to set a given hydraulic line pressure on the press. Such hydraulic line pressure would correspond to a given unit pressure (say 150 psi) over a given length (L) and width (W) of plywood charge. Where the press charge does not vary often, this system presents little problem, but where not only the charge size but the unit pressure desired varies often, the charts are a nuisance. They are easily misread, it is fairly easy to get the wrong chart for a given press or a given unit pressure, and there are size combinations not found on any chart of manageable size.

The control of this invention as disclosed herein does away with all these problems by allowing the desired unit pressure to be set and the length and width of the plywood in the press to be set, and then computes and calculates the necessary line pressure for the given press. Note also that as variations on the P times L times W concept, it would be equally possible to set P times Unit Piece Area times Number of Pieces, or P times L of each piece times W of each piece times Number of Pieces and arrive at a similar result. The controller device then compares the computed pressure with the actual pressure achieved by the hydraulic press and then operates a relay as the set pressure is reached in order to stop the hydraulic pressure structure. It is also possible to anticipate the set pressure points so that pump coastings would not cause overrun of the pressure and thus exceeding of said desired pressure.

Basically, the controller of this invention creates a voltage proportional to the product of P times L times W and compares this voltage to the output of a pressure transducer in the hydraulic line of the press. The same basic electronic controller arrangement will be usable for any press, the changes necessary to match a given press are merely a change of minor components such as resistors and the pressure transducer. Also, the overrun compensation circuit is adjustable to suit any situation.

The hydraulic press mechanism itself may vary considerably. The size of the platens, the number of openings, the pump arrangement and many other details may vary, but the electronic controller of this invention will still be applicable to these presses. In general, the control circuits for this type of press will consist of a timer and a pressure controller which together control the amount of duration of the pressure applied. Usually, one set of contacts controls the pump(s) which will be either on or off. Thus, one can see that the general hookup of the overall controller can be easily made and adapted to many existing and conventional-type presses in the field today. Also, it is envisioned that this controller may be usable with many other type systems involving hydraulic, pneumatic or fluid-type pressure systems.

Specific application of this system has been made with a hydraulic plywood press of the berthelsen type disclosed in U.S. Pat. No. 2,784,754, to which specific incorporation by reference is hereby made. However, as mentioned above, the controller of this invention may be used with many different types of hydraulic and pneumatic presses and the application to the one of the Berthelsen type is mainly provided as reference and background material and is not intended as a limitation to the inventive concept of the overall device. Also, the different circuit arrangements as disclosed and described herein may be varied to some degree and it is the overall controller concept rather than the specific circuitry that is most important to this invention.

These together with other objects and advantages which will become subsequently apparent, reside in the details of construction and operation as more fully hereinafter described and claimed, reference being made to the accompanying drawings forming a part hereof, wherein like numerals refer to like parts throughout.

BRIEF DESCRIPTION OF THE DRAWINGS

FIG. 4 is a perspective view of a control box which may be used for holding the electronic components represented in the schematic diagram of FIGS. 3*a* and *b*.

FIG. 5 is an enlarged view of the screw contact board of the control box of FIG. 4.

FIG. 6 is a portion of the present type table as used with hydraulic presses which do not have the system and controller of this invention.

FIG. 10 is a schematic diagram of the Alarm unit as used with the controller of this invention.

FIG. 11 is a table relating the terminals of the contact board to the components in the controller of this invention.

FIG. 12 is a block diagram showing the relationship between units.

DESCRIPTION OF THE PREFERRED EMBODIMENT

Figure 1:
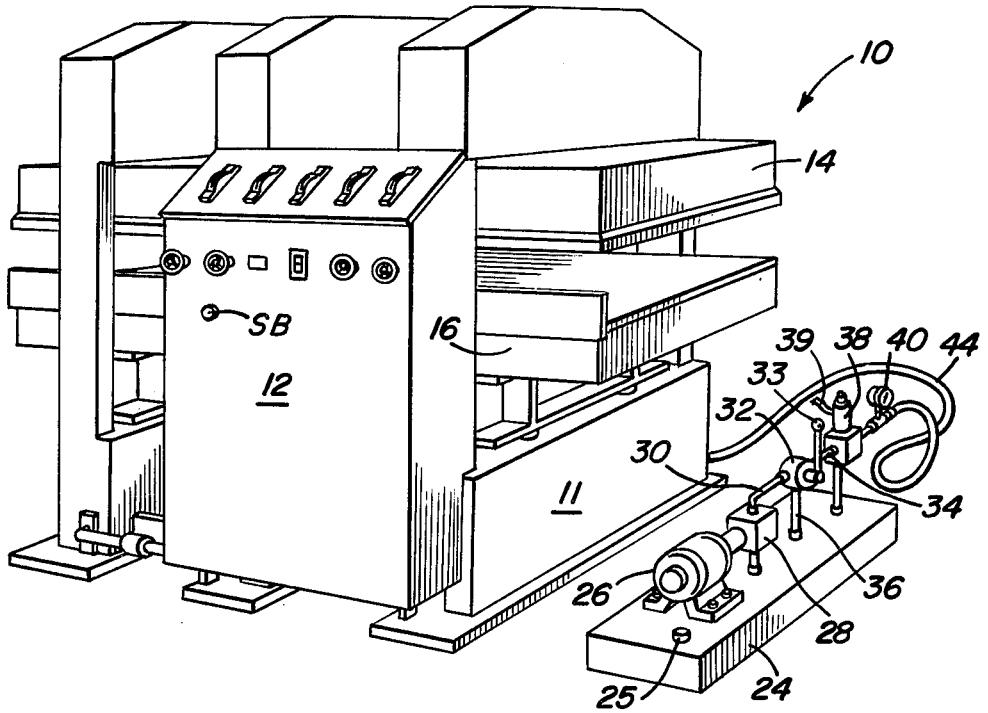
FIG. 1 is a perspective view of a typical hydraulic press as used in combination with the controller of this invention.
Figure 2:
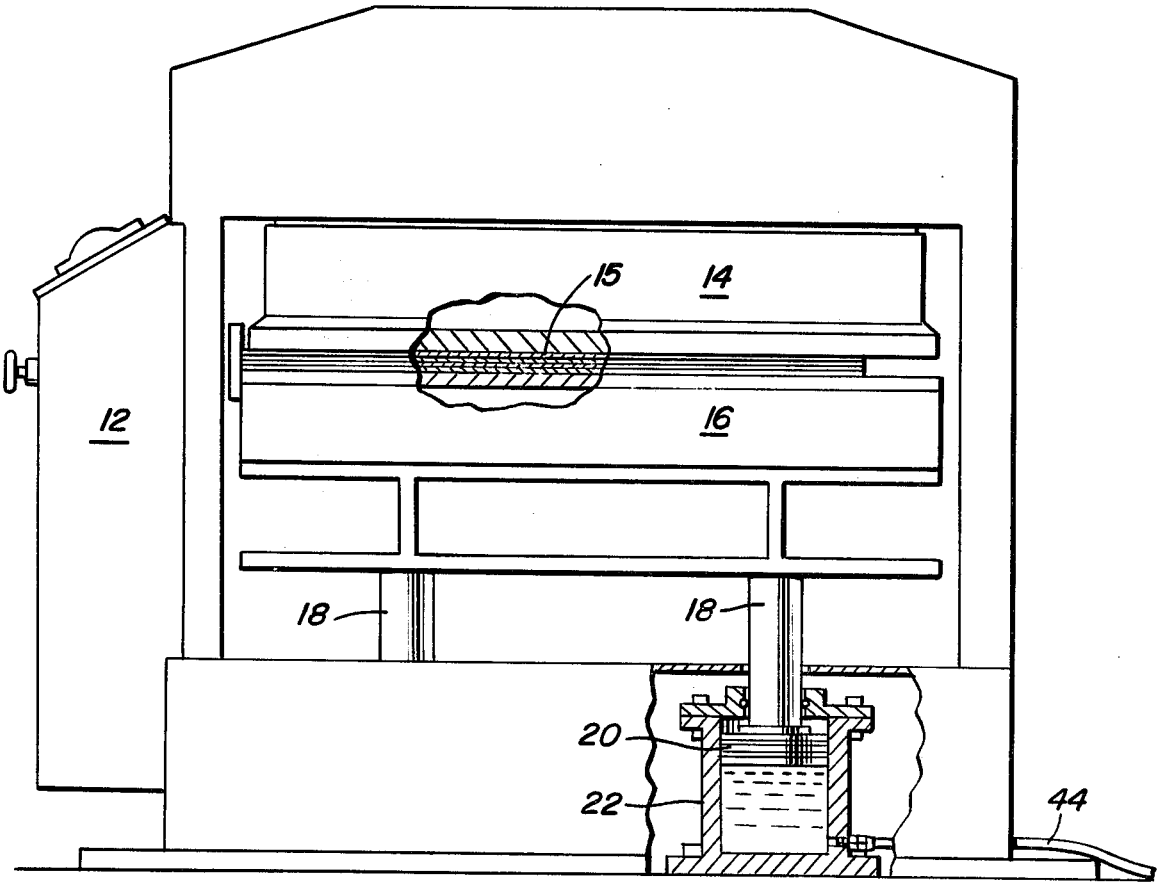
FIG. 2 is a side elevational view of the press of FIG. 1.

Referring to FIG. 1 of the drawings, reference numeral 10 indicates in general, a conventional-type hydraulic, plywood press with which the controller of this invention is intended to be used. This press which as mentioned above may be generally of the Berthelsen type, has main support structure 11, a controller unit 12, a fixed platen 14, and a movable or thrust platen 16. The plywood blanks 15 are inserted between the platens 14 and 16 and the desired amount of pressure applied to the hydraulic rams 18 for the platen 16. Both of the platens 14 and 16 may be provided with means for heating same as is conventional in the field.

The thrust platen 16 preferably is actuated hydraulically, although fluid actuated means in general, such as compressed air, or even mechanical means may be used for effecting its reciprocation between open and closed positions. In the illustrated embodiment, the platen 16 is actuated by means of the piston rod 18 connected to piston 20 which reciprocates within the hydraulic cylinder 22.

The cylinder 22 is supplied with hydraulic fluid from the reservoir 24, shown in FIG. 1 as a separate unit primarily for ease of illustration. The reservoir 24 has a supply opening and cap therefor 25 and a motor 26 mounted thereupon. The motor 26 drives a pump 28 which pumps fluid from the reservoir through a conduit 30 to a three-way control valve 32. This three-way control valve 32, of conventional type, directs the flow of hydraulic fluid either to the hydraulic cylinder 22 via the conduit 34 and line 44, when the apparatus is in operation, or returns it to the reservoir 24 via the conduit 36, when the press is not being used. In the former case, the fluid passes through an electromagnetically operated pressure release valve 38 with electric leads 39, gauge 40, and thence to the hydraulic cylinder 22 behind the piston 20 via the conduit 44. In this view the conduit 44 is shown as a flexible high pressure connecting hose. However, in actual installation, this mechanism generally would be contained within the press housing structure and not easily visible. Thus, when oil is pumped to the cylinder 22, it lifts the piston 20 therein and drives the thrust platen 16, thereby compressing the load 15 within the press. However, when valve 32 is turned so that the oil is not pumped to the cylinder, the pump 28 will discharge into the reservoir 24 and fluid in the ram cylinder and line 44 will also return to the reservoir as the press opens by gravitation.

The control panel 12 is normally provided with a cycle start button SB which starts the hydraulic pump(s) and closes release valve 38. The controller of this invention then controls further operation of the press structure. When the timer reaches the end of its cycle, pressure release valve 38 is opened. The timer also disconnects the pump(s) simultaneously so that it will not try to maintain pressure through the open valve 38.

Figure 3A:
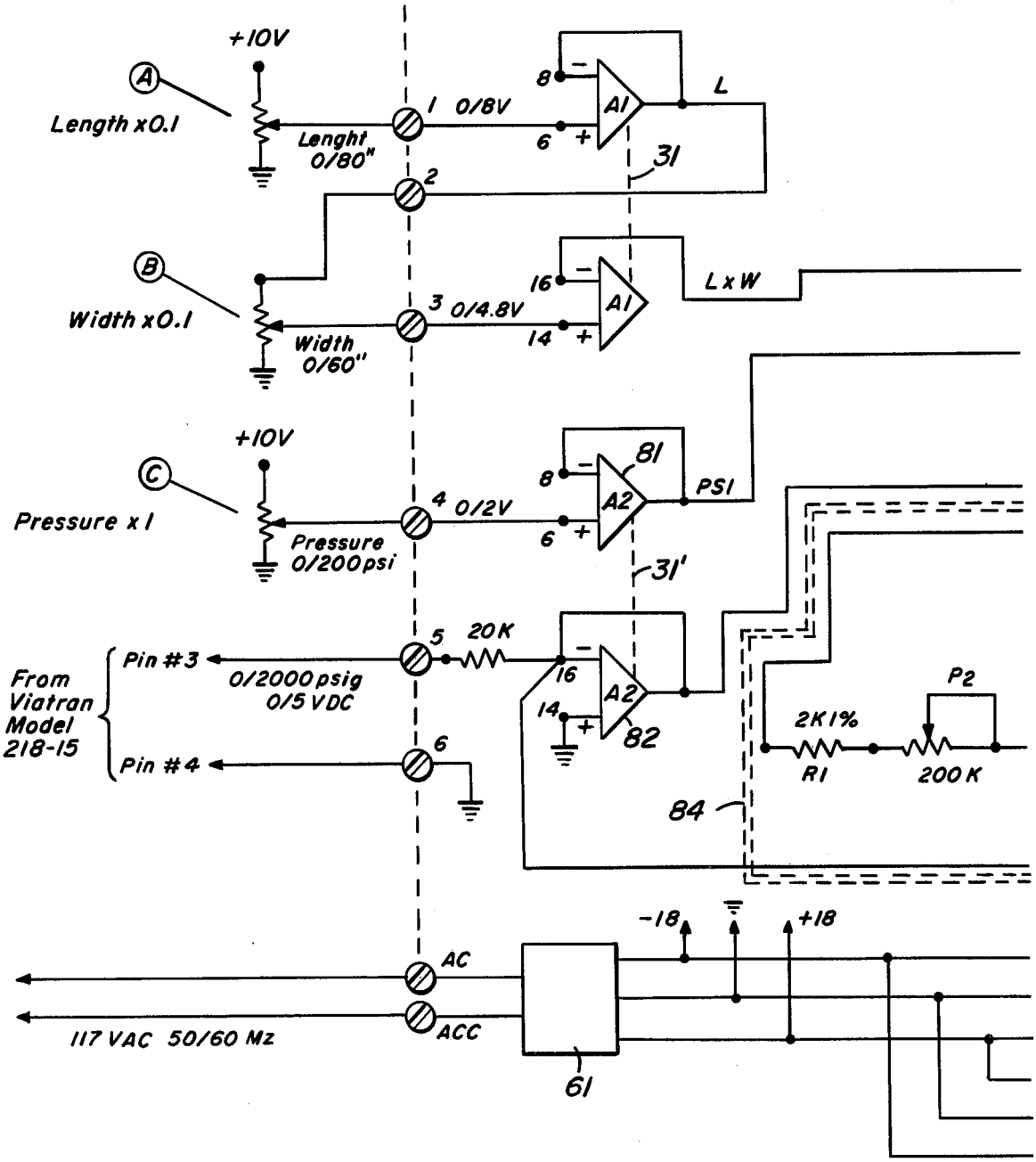
FIGS. 3*a* and *b* are an electric block diagram showing the various elements and connection thereto for the electronic controller of this invention.

Looking at FIGS. 3*a* and 3*b*, the overall arrangement of the electronic controller and the component units will now be described. The pressure controller with length and width computer consists of three input adjustments; one for plywood length in inches indicated by A in FIG. 3*a*, one for plywood width in inches indicated by B, and one for unit pressure in psi indicated by C. The three desired inputs are calibrated potentiometers which are fed from an accurate voltage source, as indicated in the schematic by plus 10 volts. The potentiometers for inputs A, B and C have been found to be satisfactory when calibrated 10 turn potentiometers are used. As seen in FIG. 3*a*, the outputs of the potentiometers are fed to buffer amplifier stages A1 and A2 to provide both isolation and stability in a conventional manner and which in turn feed the combined L times W signal and the psi pressure signal to a multiplier function module 39. The output of the multiplier module 39 is applied to both a comparator module 51 and an alarm comparator module 58. The output of the alarm module 58 is applied to a relay K1 for providing a press lockout control in the case where an impossible combination is set into the computer by an operator. In other words, if such an impossible combination is set into the computer, the alarm module will be triggered to actuate the relay K1, stop the press from functioning, and light an indicator light. This is a safety factor.

Looking at the bottom left portion of FIG. 3*a*, an input from a pressure transducer, such as the Viatron Model 218–15 which is activated by the hydraulic system of the press is connected to pins 3 and 4 and applied to buffer amplifier 82 for coupling to the other input of the comparator module 51. An anticipation circuit 84 is shown in the double dotted lines in the center of the combined FIGS. 3*a* and 3*b* which unit also receives an input from the pressure transducer for boosting the hydraulic pressure signal and performing a shut-off point anticipation signal for the controller.

The comparator 51 compares the multiplier 39 output with the signal from the pressure transducer which is activated by the press. The transducer output is boosted at low pressures by a function segment circuit that provides shut-off point anticipation. When the transducer output reaches the same level as the 39 multiplier output, the comparator module 51 trips, activating a relay K2 which is a control for the hydraulic pump system of the press.

The complete electronic controller is normally housed in a 24×24 NEMA 12 wall mounting box, as best seen in FIG. 4. The overall controller system of this invention is designed to be powered from a conventional type 117 volt ac system of 50/60 hertz by means of a power supply module 61 which supplies a plus 18 volts load supply, and a minus 18 volt supply, both referenced to a common line as indicated in FIGS. 3*a* and 3*b*. A voltage reference module 63 is also provided and powered from the output of the main power supply module 61 to provide an accurate plus 10 volt and minus 10 volt reference source.

It has been discovered in actual practice that the amplifier units A1 and A2 may be appropriately provided by dual amplifier modules such as type 20-321 available from the Bell & Howell Company. The other units of the controller also may be appropriately of the modular type and supplied from the same source. Such as the multiplier module 39 which may be type 19-309, the comparator function module 51 which may be of type 19-501; the alarm comparator module 58 which may be of type 19-508-2; the primary power supply module 61 which may be of type 19-601A; the reference voltage source module 63 which may be of type 19-603C. Also,, the relays K1 and K2 may be appropriately of type number 224562-23 while an external printed circuit board for the amplifier modules 31 may be of type 509092-01.

The dual amplifier modules 31, 31' basically contain two uncommitted amplifiers, internally trimmed, which provide the means of applying classical operational amplifier techniques without the worry of external trimming. The amplifier inputs and the outputs are connected via screw wiring connections. These amplifiers are available in F. E. T. or Bi-polar combination. When the inputs are indicated with numerals 6 and 8, the amplifier is of the Bi-polar combination type, while with inputs 14 and 16, the combination is of the F. E. T. type. External components may be applied to said amplifiers by a printed circuit board connected to the wiring terminals thereof. By the use of such a board, external components may be mounted for the special circuit designs. An example of this is shown in the amplifier A2 labelled 81 in FIG. 3*a*.

The power supply 61 for the overall controller has high reliability, performance and accuracy with very low output noise. The plus 18 and minus 18 voltage outputs are permanently set within plus or minus 0.5% of their nominal voltage. The current capability is normally of 300 Milli amps at the rated voltage. This power supply may be of the Bell & Howell type 19-601A and consists of a regulator section and an input section. The regulator section contains: rectifiers, zener diode references, and two voltage regulators. The input section contains a power transformer with two secondaries, and an electrostatic screen connected to the power supply case. Such a power supply is sufficient to supply the entire needed input for the overall controller of this invention. The plus or minus 10 volt reference module 63, may be of the Bell & Howell type 19-603C and features high accuracy with outputs permanently calibrated to within 0.025% of the rated 10 volts at 77 degrees F. Low thermal drift is provided with the drift being limited to less than 0.05% for 50 degree F. change, and short circuit protection in the case of either or both of the outputs being directly shorted. This voltage reference module has a precision zener regulator feeding two inverting operational amplifiers. It is designed for operation from the plus or minus 18 volt dc power supply of the unit 61 and provides precision reference voltage plus and minus outputs of 10 volts dc. This precision reference voltage unit is ideal for use with the overall analog computing system of the controller of this invention.

The multiplier module 39 employs the pulse-width, pulse-height modulation technique to provide very accurate, moderately fast computation, This multiplier function module may be of the Bell & Howell type 19-309. As can be seen in the schematic diagram, this multiplier computes the input of L times W and psi.

The alarm comparator module 58 compares a zero to plus 10 volt dc input signal with an internally generated zero to minus 10 volt dc set point signal to produce a voltage swing at the output terminal Xo. This output is used to drive a single pole double throw relay. The set point signal is adjustable from zero to 100% by means of a continuously adjustable potentiometer located at the bottom of the module. The relay unit may be built-in or may be provided externally of the alarm module as shown at K1 in diagram *3b*. An externally mounted diode 58' is necessary to establish a proper mode of operation. A limiting diode D1 also may be provided across the external inputs 2 and 3 of the relay K1. This comparator module is used in the controller disclosed in order to form a protective lock-out control. That is, if the combination of inputs applied to the controller by an operator is such as to form an impossible condition, the alarm comparator 58 will sense same and actuate relay K1 to prevent further operation of the hydraulic press system.

The comparator 51 may be of the Bell & Howell type 19-501, and is used to compare two voltages of opposite polarity. The result of this comparison is a voltage swing at the module output which may be used to drive relay K2 which is used to control the hydraulic pump of the press mechanism. Both the input signals X11 and X21 are referenced to the common system. Both the input signals and the trip point differential may be scaled by externally mounted coefficients. The amplitude of either polarity of output signal may be controlled by the use of an externally mounted zener diode 51'. As this comparator module is connected in the operating circuit of this controller; when the L times W times pressure output X0 from multiplier 39 is applied to input X11 and is compared with the input signal X21 from the pressure transducer of the hydraulic pressure system, the comparator 51 will actuate when the desired difference is reached in order to actuate the control relay K2 and in turn control the hydraulic pump of the press. Another limiting diode D2 may be applied across the inputs 2 and 3 of the relay K2 as shown on the schematic.

As shown in the schematic of FIGS. *3a* and *3b*, the anticipation circuit 84 has an input from the output X0 of comparator 39 which is applied to a fixed resistor R1 of approximately 2000 ohms and in turn an adjustable potentiometer P2 of a range of zero to 200,000 ohms to an input 8 of the amplifier 89. An adjustable potentiometer P1 also provides a reference potential to this input. The other input 6 of the amplifier 89 is connected to the common line of the overall system. A feedback diode D12 together with output diode D22 and feedback resistor R3 is also provided. A resistor R4 connects the output 9 to the output point 13 of this portion of the controller for feeding back to the amplifier 82 and the input 16 thereof. This arrangement of anticipation circuitry will function to operate the comparator 51 and relay K2 to turn off the hydraulic pump of the hydraulic press before the desired total hydraulic pressure of predetermined value is reached. This takes care of the override which is inherent in the system and by appropriate adjustment will accurately control the hydraulic press pump system.

All of the connecting wiring to the pressure transducer and the like must be appropriately shielded. The total resistance of the wires should be kept as low as possible, and obviously as distance between the pressure transducer and the controller increase, the size of wire must be increased. The appropriate range of input voltages and power and reference voltages are indicated on the schematics and will not be described herein in detail. Also the ranges and values as shown are indicative only of workable operating values, and may be varied as desired within the overall concept of this invention.

Figure 7:
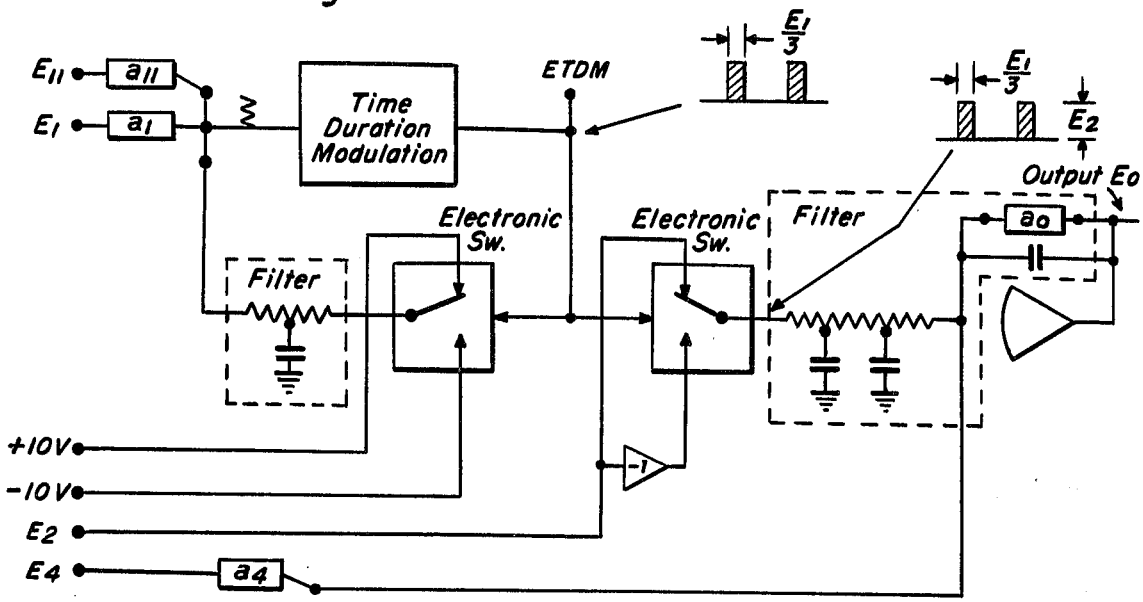
FIG. 7 is a schematic diagram of the Multiplier unit as used with the controller of this invention.

Some of the various component units of the overall controller will now be described in detail. Looking at FIG. 7 of the drawings, the schematic diagram of the multiplier unit 39 may be seen. This preferably will be provided as a completely functional modular unit which may be easily connected into the overall circuit by terminal connections or plug-in type connections. This unit is usable over four quadrants and inputs and output are scalable by use of external coefficients mounted on the face of the module. The unit as shown in the schematic employs pulse-width, pulse-height modulation technique in order to provide very accurate, moderately fast computation. The pulse width is proportional to the ratio of $a_1E_1/E_3$ where E3 equals 10 volt dc as applied to the unit. Pulse-height is proportional to E2. The multiplier unit as shown in this schematic will solve the equation $$E_o = a_o\left(\frac{a_1E_1 + a_{11}E_{11}}{10} E_2 - a_4E_4\right)$$

(the terms $a_{11}$, $E_{11}$ and $a_4$, $E_4$ are optional) volts, where E equals voltage level, a equals gain factor and the subscripts 1, 2, 3, 4 and 11 are inputs and subscript 0 is output.

Figure 8:
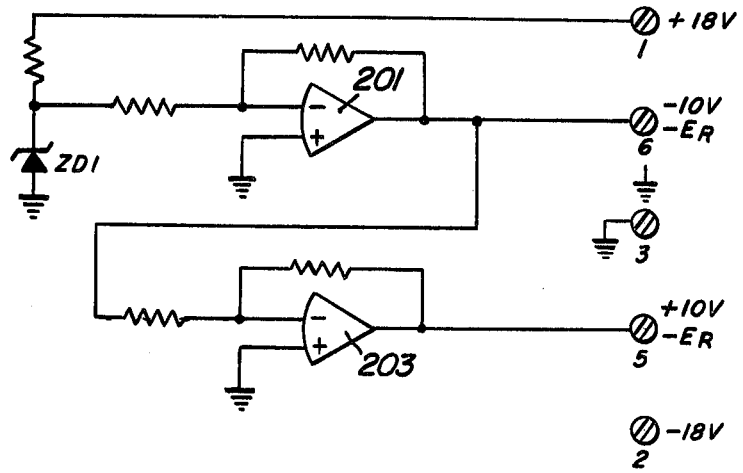
FIG. 8 is a schematic diagram of the Reference voltage unit as used with the controller of this invention.

FIG. 8 is a schematic for the reference unit module which in this particular application supplies plus and minus 10 volts. This unit preferably has very high accuracy with outputs very closely calibrated, low thermal drift, and is short circuit protected. The unit has a precision zener regulator feeding two inverting operational amplifiers. It is designed for operation with ±18 vdc power supply with the outputs being an ultrastable ±10 vdc. This unit is designed to supply a precision reference voltage standard to the analog computing system of the overall controller device. Basically, the circuit operates by the precision zener diode regulator ZD1 feeding a stable reference voltage into the first inverting operational amplifier 201 to produce a minus 10 dc output. Another inverting amplifier 203 converts the minus 10 volts to plus 10 volts for the second output. Selected resistors as appropriate are used in the connections as shown.

Figure 9:
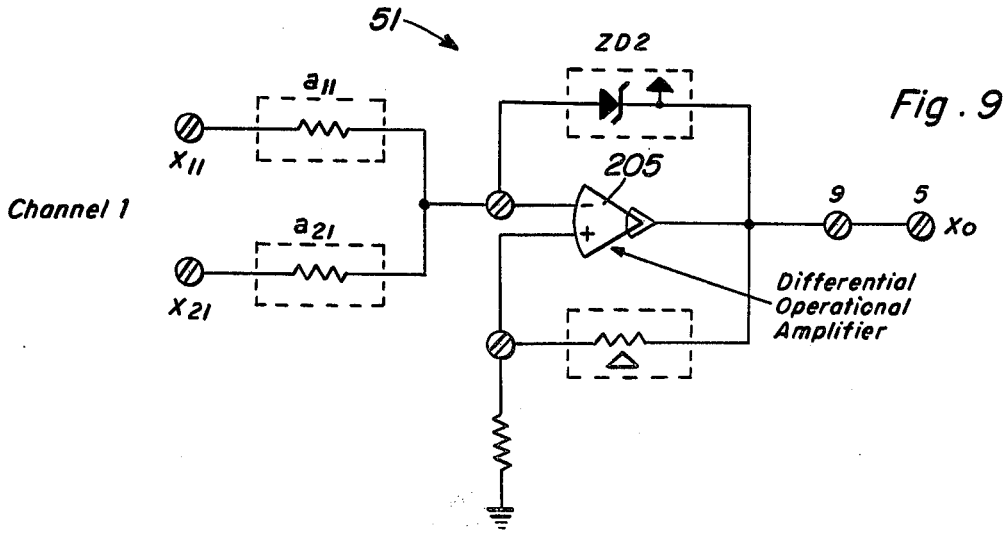
FIG. 9 is a schematic diagram of the Comparator unit as used with the controller of this invention.

FIG. 9 is a schematic diagram of the comparator unit also preferably designed as a modular type unit. This comparator unit accepts two input voltage signals of opposite sign, compares the amplitude of the two signals and produces a full scale output equal in polarity to the smaller of the two inputs. Full scale output may be limited if desired by the addition of a zener diode ZD2 as an external coefficient. Nominal inputs and outputs can be obtained by the selection of encapsulated coefficient resistors also connected to the unit. The comparator channel contains a high-gain operational amplifier 205 with a regenerative feedback supplied to the plus input of the operational amplifier. The two incoming signals to be compared, such as X11 and X21 are to be of opposite polarity and are summed by the input coefficients A11 and A21, providing an output indication of their relative amplitudes. The amplifier has very high gain, the polarity and balance provides a sensitive trigger to operate the amplifier and causes the output to swing to its maximum amplitude in the opposite polarity. The range of the output may be limited by the zener diode ZD2 connected in the feedback path of the amplifier as shown. To prevent chattering of the trip point, the changing of polarity in one direction is made slightly different from the one when changing in the opposite direction. This is accomplished by feeding back a small fraction of the output through a delta resistor as shown. The effect is expressed as a percentage of the full scale of the output voltage. This comparator unit as used with the overall controller is used to drive the relay K1 or K2 (FIG. 3*b*).

FIG. 10 is a schematic diagram of the alarm unit as may be used with the overall controller. This alarm comparator unit produces a logic output to indicate whether the input voltage applied thereto is above or below the voltage set by the potentiometer adjuster. This unit compares a zero to plus 10 volt dc input signal with an internally produced zero to minus 10 volt dc set point signal to produce a voltage swing at the X0 output terminal. This output is used to drive a SPDT relay. The potentiometer adjustor is adjustable from zero to 100% by a conventional type screwdriver slot control shaft. This is the type alarm module used in the controller schematic of FIGS. 3*a* and 3*b*.

Figure 3B:
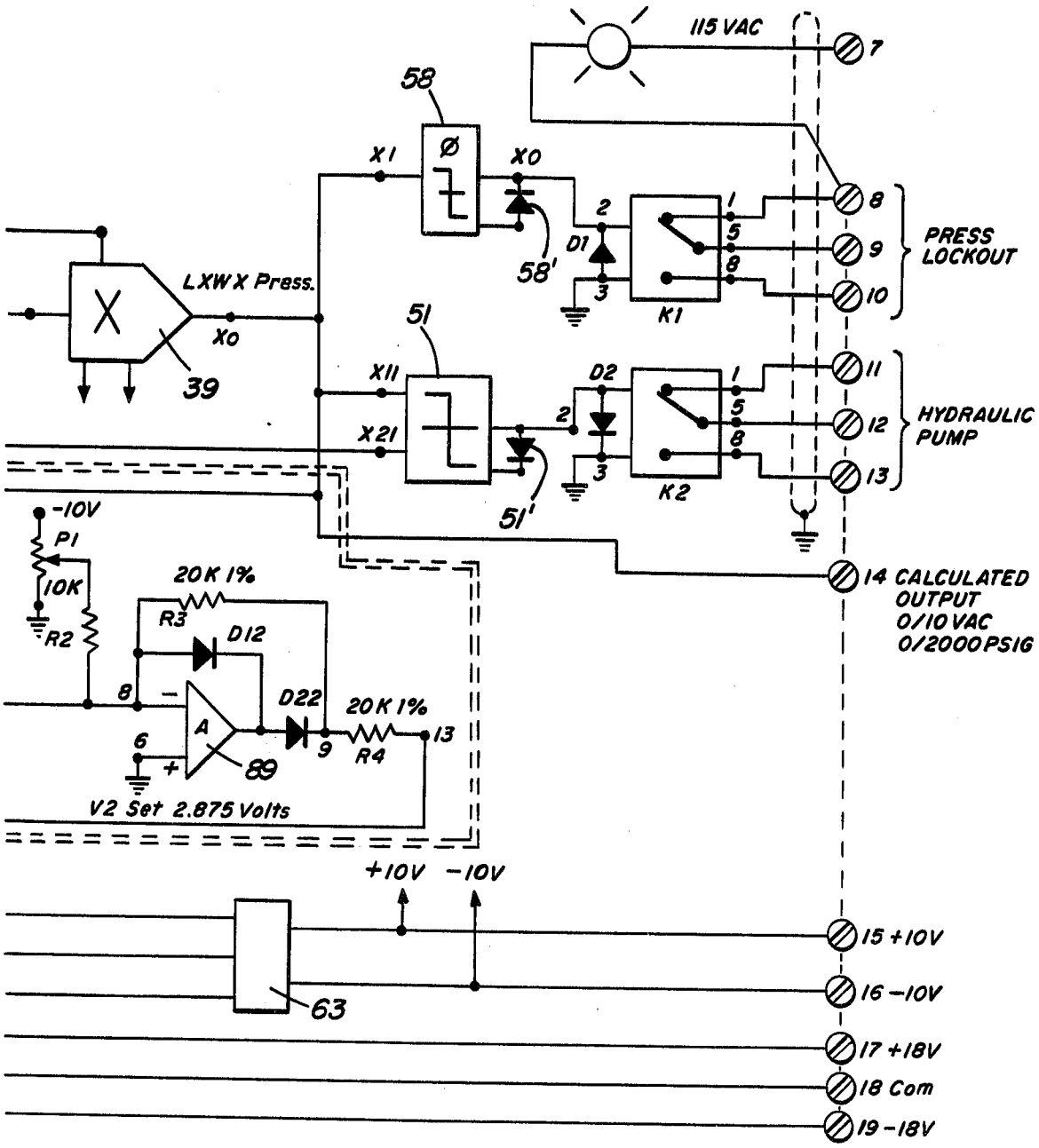

FIG. 11 is a table showing the relationship of the terminals of the contact board of FIGS. 4 and 5 in relation to the various units of the overall controller of FIGS. 3*a* and 3*b*.

The operation of the overall system will now be described with reference to the block diagram of FIG. 12. The block diagram of FIG. 12 basically shows the structure as associated with a hydraulic press having a low pressure pump motor 26 and a high pressure pump motor 26' together with a timer and associated relays.

When the start button SB (FIG. 1) is pressed, relay R1 is energized and the contacts thereof closed. These contacts in turn energize another relay R2 through a mechanical limit switch structure. The relay R2 closes electrical contacts to the pump motor 26 which starts the low pressure hydraulic pump operating and thus in turn raises the platen 16. An appropriate limit switch 92 is provided for the platen, not shown, on the press which when engaged will disengage the relay R2 and stop the low pressure pump motor 26. This limit switch 92 in turn energizes a relay R3 starting a high pressure pump motor 26'. This motor 26' also is not shown on the press, but the pump it drives is connected in series with line 44 internally of the press of FIG. 1. Relay R3 completes a circuit through the relay K2 of the controller, that is, the terminals 12 and 13 on the panel board of FIGS. 4 and 5.

When the predetermined set pressure is reached as put into the length-width input of the controller, K2 opens thus deenergizing relay R3. At this point the high pressure pump 26' stops, and the timer 94 starts timing. Should the hydraulic pressure in the system drop, relay K2 which is pressure responsive will reclose, reenergizing R3 and restarting the high pressure pump 26'. When the timer 94 runs out, its motor is stopped, and primary relay R1 is deenergized. Once the contacts of relay R1 open, the further operation of either the low pressure pump 26, or high pressure pump 26' is prevented, and the solenoid operated valve 38 is energized through leads 39 and the timer contacts. The solenoid operated valve 38 relieves the hydraulic fluid from the ram, causing the platen to lower. Should an excessive pressure, length, and width combination be set on the length-width computer, K1 opens breaking the circuit to the stop button. This will prevent the hydraulic pump from starting or operating. The anticipation unit 84 will also function as described above and in conjunction with the aforesaid operation to prevent excess pressure buildup.

Whether a single pump 26 is used for the press, or two pumps 26 and 26' are used is immaterial. The controller of this invention "sees" only a single pressure as fed to it from the transducer means attached to the pressure systems. In the case of two pumps, the switch from the low pressure pump to the high pressure one, as indicated in the block diagram of FIG. 12, may be provided in the press itself through use of the limit switch and relay means as described above. This arrangement may be varied without changing the overall operation and effect of the electronic controller of this invention.

The screw terminal panel in FIG. 5 together with the terminal connections of FIG. 11 and the output terminals of FIG. 3*b* are all related in a manner believed to be self-explanatory from viewing of the Figures.

FIG. 6 shows the conventional-type table wherein an operator must visually determine the length and width of a piece of plywood to be put under pressure in order to determine the necessary hydraulic pressure in pounds per square inch. The electronic controller of this invention will substantially eliminate the use of such tables.

Figure 13:
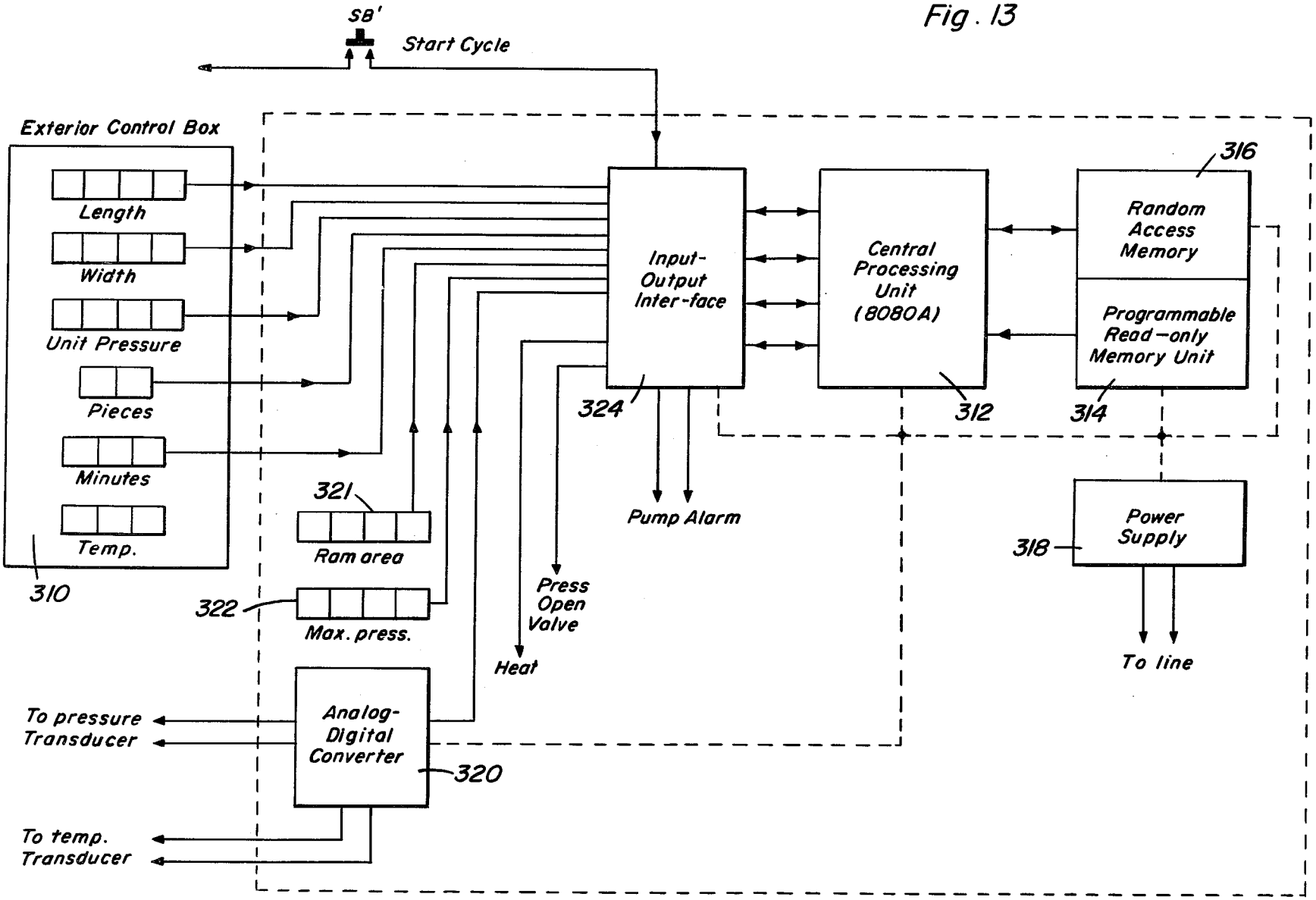
FIG. 13 is a block diagram showing another embodiment having a Digital-type Press Controller.

The embodiment as depicted in FIG. 13 of the drawings will now be described. This embodiment relates to a press controller similar to the one already described but of the digital type. An exterior control box 310 is provided which may be mounted upon a control panel similar to 12 of FIG. 1. This exterior box has a plurality of digital switches which are mounted thereon for such items as length, width, unit pressure, number of workpieces, minutes, and temperature. This digital-type press controller also has a central processing unit 312, a programmable read-only memory unit 314, a random access memory unit 316, a power supply unit 318, an analog-digital converter 320, an internal digital switch 312 for ram area, another internal digital switch 322 for maximum pressure, and an input-output interface unit 324.

These various units are interconnected as shown on the diagram of FIG. 13 so as to function with the following sequence of operation. When connected with a hydraulic plywood press as in the embodiment previously described, the length and width of the plywood parts, the number of parts, the desired unit pressure, the desired cycle length in minutes, and the desired temperature are all preset on the digital switches of the exterior control box 310. This could be L and W of each part times the number of parts or L and W of aggregate parts times one part. Upon pushing the start button SB' to start the cycle, the central processing unit 312 (CPU), as directed by the prewritten program previously stored in the PROM unit 314, computes the desired line pressure (L times W times number of pieces times unit pressure per ram area), starts the hydraulic pump(s) as in the first embodiment, and stops same when the calculated pressure is reached, simultaneously beginning to count the cycle time as set. If the computed pressure is greater than that set in the "max pressure" switch 322, the alarm only is actuated. (This alarm being similar to that previously described). When the set time is reached, the pump(s) is set to "off", the press open valve is energized and the timer is reset. The temperature regulation is carried on all the time that the unit is on (it may prove desirable to have provision for anticipation of temperature drop upon first closing the press, if so, it is a simple program function. Likewise, anticipation of the pressure overrun can be a program feature if desired). Ram area and Max pressure switches 321 and 322 are internal and are set only once, to customize the controller to the given press constants with which it is used. The analog to digital converter 320 takes the analog output of the pressure transducer and temperature transducer associated with the press and converts them to a usable digital form for the central processing unit 312. The random access memory unit 316 (RAM) is used by the CPU 312 to store results of computations and as a "scratch" pad. The input-output interface unit (I-O) 324 provides the necessary signal conditioning between the CPU 312 and the various input and output devices. All of these units may be of the solid state and microprocessing type.

From this description and showing of FIG. 13, it can be easily visualized how a digital system may be used for the electronic controller system for hydraulic plywood presses and the like to offer a degree of control and flexibility never before achievable.

The foregoing is considered as illustrative only of the principles of the invention. Further, since numerous modifications and changes will readily occur to those skilled in the art, it is not desired to limit the invention to the exact construction and operation shown and described and accordingly all suitable modifications and equivalents may be resorted to, falling within the scope of the invention as set forth in the claims which follow.

What is claimed as new is as follows:

1. A controller device for use with a hydraulic press having a fluid pressure system for making plywood and the like comprising: means for applying input signals representing predetermined values, processing means for receiving the input signals and to provide an output representative thereof, transducer means for sensing fluid pressure generated in the press, means for comparing the output of the processing means and the pressure sensed by the transducer means in order to control the fluid pressure system of the press, and alarm means for preventing operation of the fluid pressure system in case the input signal values as preset into the controller are for impossible conditions.

2. The structure as set forth in claim 1, including a compensator unit responsive to pressure sensed by the transducer means for anticipating fluid pressure override due to inertia in said system and means connected to the compensator unit for deenergizing the system to prevent said override.

3. A controller device for use with a hydraulic press having a fluid pressure system for making plywood and the like comprising: means for applying input signals representing predetermined values, processing means for receiving the input signals and to provide an output representative thereof, transducer means for sensing fluid pressure generated in the press, and means for comparing the output of the processing means and the pressure sensed by the transducer means in order to control the fluid pressure system of the press, the means for applying input signals including at least two adjustable potentiometers of the multiple turn and accurate analog type.

4. A controller device for use with a hydraulic press having a fluid pressure system for making plywood and the like comprising: means for applying input signals representing predetermined values, processing means for receiving the input signals and to provide an output representative thereof, transducer means for sensing fluid pressure generated in the press, and means for comparing the output of the processing means and the pressure sensed by the transducer means in order to control the fluid pressure system of the press, the means applying input signals including at least two adjustable switches of the digital type.

5. A controller device for use with a hydraulic press having a fluid pressure system for making plywood and the like comprising: means for applying input signals representing predetermined values, processing means for receiving the input signals and to provide an output representative thereof, transducer means for sensing fluid pressure generated in the press, and means for comparing the output of the processing means and the pressure sensed by the transducer means in order to control the fluid pressure system of the press, the means for applying input signals representing predetermined values into the device including analog controls, the processing means for receiving the input signals to provide an output representative thereof including a multiplier unit, and the comparing means including a comparator unit.

6. A controller device for use with a hydraulic press having a fluid pressure system for making plywood and the like comprising: means for applying input signals representing predetermined values, processing means for receiving the input signals and to provide an output representative thereof, transducer means for sensing fluid pressure generated in the press, and means for comparing the output of the processing means and the pressure sensed by the transducer means in order to control the fluid pressure system of the press, the means for applying input signals representing predetermined values into the device including digital input units, the processing means for receiving the input signals to provide an output representative thereof including a microprocessing-type unit, and the comparing means including a solid state input-output interface unit.

7. In combination with a fluid power mechanism having pump means energized to generate an increasing line pressure under load, a controller system comprising a plurality of data input devices for entering selected pressure and dimensional inputs, interface means connecting said data input devices to the fluid power mechanism for energization of the pump means during an operational cycle of the fluid power mechanism, data processing means connected to said interface means for computing a line pressure value corresponding to the selected inputs entered through the data input devices, sensor means connecting the interface means to the fluid power mechanism for comparing the increasing line pressure of the pump means with said computed line pressure value, and means connected to the data processing means for deenergizing the pump means in response to approach of the increasing line pressure to the computed line pressure value preventing pressure overrun of the fluid power mechanism.

8. The combination of claim 7 wherein said pump means coasts under inertia of the system upon deenergization of the pump means to attain the computed line pressure value without overrun.

* * * * *